US006230820B1

(12) United States Patent
Cordry

(10) Patent No.: US 6,230,820 B1
(45) Date of Patent: May 15, 2001

(54) UNIVERSAL DRIVE POINT DEVICE

(76) Inventor: Kent E. Cordry, 308 Mountaire Pkwy., Clayton, CA (US) 94517

( * ) Notice: Subject to any disclaimer, the term of this patent is extended or adjusted under 35 U.S.C. 154(b) by 0 days.

(21) Appl. No.: 08/991,171

(22) Filed: Dec. 16, 1997

(51) Int. Cl.[7] ..... E21B 49/08

(52) U.S. Cl. ..... 175/20; 175/58
(58) Field of Search ..... 175/20, 21, 22, 175/23, 314, 58, 59; 405/253, 254

(56) References Cited

U.S. PATENT DOCUMENTS

| | | | |
|---|---|---|---|
| 58,479 | 10/1866 | Rhoades . | |
| 58,721 | 10/1866 | Duck et al. | 175/314 |
| 58,769 | 10/1866 | Bruen | 166/103 |
| 64,192 | 4/1867 | Budd | 175/22 |
| 73,414 | 1/1868 | Welch et al. | 175/22 |
| 73,688 | 1/1868 | Arnold | 175/22 |
| 166,136 | 7/1875 | Patterson | 175/314 |
| 634,312 | 10/1899 | Swaby | 175/22 |
| 1,211,415 | 1/1917 | Cross | 175/22 |
| 1,489,916 | 4/1924 | Blamphin | 255/14 |
| 1,514,585 | 11/1924 | Edwards . | |
| 1,894,446 | 1/1933 | McKenny | 175/22 |
| 1,998,075 | 4/1935 | Church | 255/72 |
| 2,085,972 | 7/1937 | Halliburton | 166/1 |
| 2,141,261 | 12/1938 | Clark | 166/21 |
| 2,358,089 | 9/1944 | LeGere | 248/156 |
| 2,374,227 | 4/1945 | Metcalf | 23/232 |
| 2,376,366 | 5/1945 | Lawlor et al. | 23/232 |
| 2,513,944 | 7/1950 | Kessler | 175/314 |
| 2,629,444 | 2/1953 | O'Donnell | 166/157 |

(List continued on next page.)

FOREIGN PATENT DOCUMENTS

| | | | |
|---|---|---|---|
| 221793 | 5/1985 | (DE) | 166/264 |
| 1035198 | 8/1983 | (SU) | 166/264 |

OTHER PUBLICATIONS

BAT Envitech, Inc., brochure entitled "BAT® Groundwater Monitoring System," (date unknown). 6 pages.
Earth Technology Corporation, "Cone Penetrometer Testing," Brochure (date unknown). 17 pages.
GeoInsight brochure featuring HydroPunch II™ (date unknown) 7 pages.
Ground Water Monitoring Review, Winter 1990, cover page and p. 198.
Johnson Division, UOP, Inc., "Johnson Watermark Stainless Steel Drive Points," SSDP (one information page).

(List continued on next page.)

*Primary Examiner*—Hoang Dang
(74) *Attorney, Agent, or Firm*—Christie, Parker & Hale, LLP

(57) ABSTRACT

A sampling device is provided for driving into the ground to sample fluids at a desired depth without requiring the drilling of a well. The sampling device utilizes a universal drive point device which is removably coupled to a tubular point holder. The drive point device includes an outer surface which extends along a drive cone between a lower end and an upper end along a longitudinal axis. The outer surface tapers radially outwardly from the lower end and is adapted for penetrating the ground to form a borehole. A stub extends outwardly along the longitudinal axis from the upper end of the drive cone. The stub is configured for insertion within a bottom end of the tubular point holder. The stub includes an axially elongated circumferential groove. An elongated annular seal is seated within the circumferential groove. The annular seal is adapted for frictionally coupling and sealing against an inner diameter within the bottom end of the tubular point holder. The annular seal is highly compressible and expandable to accommodate tubular point holders of different inner diameters.

26 Claims, 6 Drawing Sheets

U.S. PATENT DOCUMENTS

| | | | | |
|---|---|---|---|---|
| 2,870,844 | | 1/1959 | Barnes | 166/165 |
| 3,367,188 | | 2/1968 | Robinson | 73/425.2 |
| 4,310,057 | * | 1/1982 | Brame | 175/21 |
| 4,352,477 | | 10/1982 | Garrett et al. | 248/156 |
| 4,438,654 | | 3/1984 | Torstensson | 73/864.52 |
| 4,526,230 | | 7/1985 | Kojicic | 166/236 |
| 4,583,594 | | 4/1986 | Kojicic | 166/236 |
| 4,649,996 | | 3/1987 | Kojicic et al. | 166/228 |
| 4,669,554 | | 6/1987 | Cordry | 175/59 |
| 4,804,050 | | 2/1989 | Kerfoot | 175/20 |
| 4,807,707 | | 2/1989 | Handley et al. | 175/20 |
| 4,953,637 | * | 9/1990 | Starr et al. | 175/20 |
| 5,046,568 | | 9/1991 | Cordry | 175/21 |
| 5,146,998 | | 9/1992 | Cordry et al. | 175/22 X |
| 5,168,765 | | 12/1992 | Broussard | 73/864.74 |
| 5,176,219 | * | 1/1993 | Cole et al. | 166/290 |
| 5,186,263 | | 2/1993 | Kejr et al. | 175/23 |
| 5,327,981 | | 7/1994 | Morgan | 175/21 |
| 5,449,045 | | 9/1995 | Cordry | 175/20 |
| 5,540,294 | * | 7/1996 | Anderberg | 175/19 |
| 5,570,747 | | 11/1996 | Cordry | 175/20 |
| 5,669,454 | | 9/1997 | Cordry | 175/20 |

OTHER PUBLICATIONS

K–V Associates, Inc., Analytical Systems Division, Ground Water Monitoring Review, Apr. 1989, pp. 61–62. (2 pages).

K–V Associates, Inc., Analytical Systems Division, Brochure No. 21, Apr. 1993. 7 pages.

Kerfoot, W.B., "A Portable Well Point Sampler for Plume Tracking," Fall 1984, pp. 38–42. 5 pages.

Reference to D. Well Points and E. Well Clusters, (source and date unknown) pp. 73 and 83.

Summerfield, R.J., "A Probe for Sampling Mire Waters for Chemicals and Gas Analysis," Plant and Soil, vol. 38, No. 2 (Short Communication), Apr. 1973, pp. 469–472.

Thompson et al., "Soil Gas Contaminant Investigations: A Dynamic Approach," *Ground Water Monitoring Review,* Summer 1987, pp. 88–93.

Torstensson, B.A., "A New System for Ground Water Monitoring," Fall 1984, pp. 131–138.

* cited by examiner

UNIVERSAL DRIVE POINT DEVICE

FIELD OF THE INVENTION

This invention relates generally to sampling and drive point devices and more particularly, to a drive point device useful with various sized sampling devices for underground fluid sampling, groundwater sparging, soil gas extraction, groundwater extraction and groundwater monitoring.

BACKGROUND OF THE INVENTION

Increased environmental concerns, including the quality of groundwater has prompted increased government regulations and testing requirements for groundwater supplies. These regulations include requirements relating to the monitoring and sampling of groundwater quality and contamination levels. In response to these regulations, numerous devices have been developed for groundwater sampling and monitoring, such as those described in my prior issued U.S. Pat. Nos. 4,669,554; 5,046,568; 5,449,045; 5,570,747 and 5,669,454.

These devices are commonly known as sampling devices and typically include a drive point having a lower portion configured for penetrating the ground and an upper portion which is removably coupled to a tubular drive point holder or extension tube. An elongated annular drive rod is coupled to an upper end of the tubular drive point holder to extend its length and to facilitate driving of the drive point into the ground. An annular seal between the drive point and the point holder prevents the ingress of groundwater or soil during insertion of the sampling device. An interior pipe extends through the annular drive rod and the tubular drive point holder. This internal pipe includes a fluid passageway at its bottom end which allows groundwater to enter. The groundwater can then be extracted or otherwise accessed for sampling.

In a typical operation, a section of the elongated annular drive rod is coupled to the tubular point holder which is in turn removably coupled to a drive point. The upper end of the annular drive rod is pushed, driven or otherwise forced into the ground to form a borehole. Additional sections of annular drive rods may be sequentially connected together to form a pipe string and increase the depth of penetration. The sampling device eliminates the need for drilling, digging or other well operations as well as the associated need to remove or otherwise handle the displaced soil. These advantages are particularly useful when testing in contaminated soil.

Once the drive point reaches the desired location and depth, the annular drive rod, including the attached tubular point holder and any attached pipe string are withdrawn slightly. This slight retraction causes a portion of the sampling device and particularly, the tubular point holder, to slide upward with respect to the drive point which is frictionally restrained in the ground. This upward sliding motion opens a flow path between the drive point and the retracted tubular drive point holder and permits groundwater to enter the sampling device at the desired depth only. The groundwater is then accessed through the interior pipe to be tested, sampled or otherwise treated. The annular drive rod, including any attached drill string is then removed, leaving the drive point and interior pipe within the ground.

Currently, several manufacturers supply this general type of sampling device. Each manufacturer has their own style and configuration as well as differing sizes. These differing sampling devices, including those having different diameters, are used to creating different diameter boreholes and to accommodate various quantities of groundwater as well as to allow usage with different diameter drive rods. As a result, each manufacturer produces a specific drive point which is sized to couple with each of their specific tubular point holders. However, all of these drive points are commonly configured, including a protruding stub extending from an upper end and an o-ring to provide the frictional connection and the watertight seal against the inner diameter of the tubular point holder.

As a consequence of the above design, the stub and o-ring on each drive point, although commonly configured, will only frictionally and sealably fit into a sampling device having a specific interior diameter. This results in a specifically sized drive point being required for each sampling device size as well as for each sampling device manufacturer. Retailers and users are thus, required to stock numerous different drive points for each of the different sized sampler devices, including those by each manufacturer. These drive points may be substantially identical, with the exception of the stub and o-ring sizes. Operator confusion, down time and additional costs result when the right sized drive point is not available for the sampling device being used. In addition, each user is required to expend a major cost to stock and support the large number and variety of drive points required for the multiple sized sampling devices. There is thus a need for a drive point which could universally fit a large variety of sampling devices and particularly a wide range of tubular point holder diameters.

A number of devices and techniques have been provided for supplying a single drive point which can fit sampling devices of various sizes and configurations. In one such example, the drive point has a stub supporting two spaced apart o-ring grooves. Each of the o-ring grooves is a different size to accommodate a different sized o-ring and thus, seal against point holders of at least two different inner diameters.

In another configuration, an annular shim is placed over the stub to accommodate and seal against a larger diameter point holder. The annular shim is slid over the smaller diameter stub to form a larger outer diameter stub which supports a corresponding larger diameter o-ring. The annular shim accommodates and seals against a point holder having a larger inner diameter.

These configurations, devices and techniques however, have some disadvantages. In general, the stub having the two spaced apart o-ring grooves is difficult to use and only increases the functionality of the drive point slightly. This is due, in part, because o-rings are relatively hard and not sufficiently compressible and expansive to accommodate the various inner diameters of the different tubular point holders. Annular shims are not practical because they just require another component, further frustrating the need to simplify and reduce the overall number of required components. In addition, shims provide an additional path for leakage into the interior pipe before the sampling device reaches the desired location and depth. There is thus a need for a universal drive point device which is capable of frictionally coupling with and sealing against a tubular point holder having a range of inner diameters. There is also a need for such a drive point device which is simple to use and inexpensive to manufacture.

SUMMARY OF THE INVENTION

The present invention overcomes the aforementioned problems by providing a single drive point device having an annular seal which is formed of a highly compressible and expandable material and which is capable of sealable connection with tubular point holders having a range of inner diameters. The annular seal also includes an outer surface configured for frictionally coupling against the inner diameter of the tubular point holder. By providing the annular seal of the present invention, the drive point device may be inserted into the tubular point holder until the annular seal is sufficiently compressed to frictionally retain the drive point device within the tubular point holder, as well as sealing between the two.

The present invention is generally directed to a drive point device for removable coupling with a tubular drive point holder. The drive point device includes a drive point lower portion or drive cone having an outer surface which extends between a lower end and an upper end along a longitudinal axis. The outer surface of the drive cone is tapered radially outwardly between the lower end and the upper end to create a relatively sharp tip for penetrating the ground. A stub protrudes longitudinally from the upper end of the drive cone and includes an annular or circumferential groove. The stub is adapted for removable insertion within a bottom end of the tubular point holder.

An annular seal is seated within the circumferential groove of the stub. The annular seal is adapted for frictionally coupling against an inner diameter within the bottom end of the tubular point holder and is highly compressible and expandable to facilitate coupling with tubular point holders of various inner diameters. The annular seal also seals against the inner diameter of the tubular point holder to prevent the passage of any fluids or soil into the interior of the tubular point holder.

In one aspect of the present invention, the circumferential groove has a uniform diameter along its axial length and the annular seal is configured with an elongated and tapered outer surface. The tapered outer surface increases in diameter from an upper groove wall of the circumferential groove axially downward to a lower groove wall. This configuration allows the annular seal to accommodate tubular point holders of various inner diameters. More specifically, the stub may be inserted into the tubular point holder bottom end until the annular seal contacts and seals against the inner diameter within the bottom end of the tubular point holder. Further insertion of the stub compresses the annular seal and creates a frictional coupling which retains the drive point within the drive point holder.

In another aspect of the present invention, the drive point device includes a stub having an axially elongated circumferential groove which includes a tapered inner groove surface. The circumferential groove supports the annular seal and tapers the outer surface of the annular seal along the tapered groove inner surface. Unlike the previous aspect of the present invention, wherein the seal itself had a tapered outer surface, in this aspect, the seal has a uniform annular thickness, i.e. a cylindrical shape, but is forcibly tapered due to the tapered inner groove surface. The inner groove surface tapers radially outwardly along the longitudinal axis from an upper groove wall to a lower groove wall and forces the seal to similarly taper.

In yet another aspect of the present invention, the drive point device includes an upper stub portion which is configured for connection with a lower end of a perforated interior pipe. The upper stub portion includes a threaded portion along its axial length over which the perforated pipe may be centered and threaded. In this configuration, the perforated pipe lower end is coupled to the drive point device and maintained in the ground at the desired location and depth.

This invention, together with the additional features and advantages thereof, which was only summarized in the foregoing passages, will become more apparent to those of skill in the art upon reading the description of the preferred embodiments, which follows in the specification, taken together with the following drawings.

DESCRIPTION OF THE PREFERRED EMBODIMENTS

Figure 1:
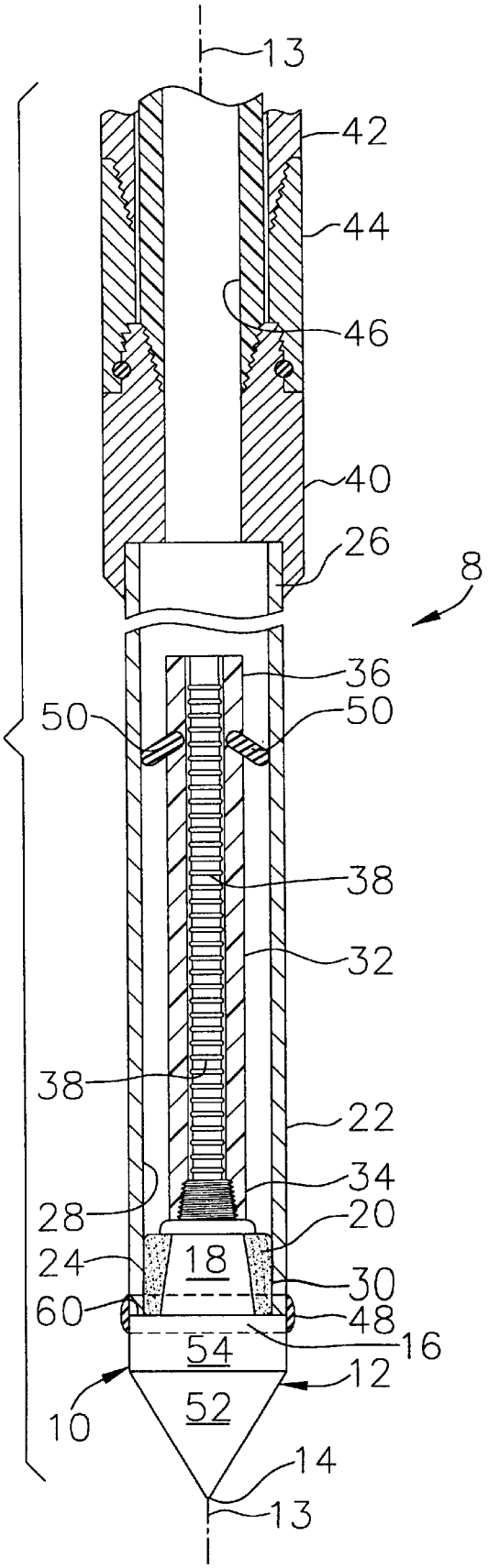
FIG. 1 is a schematic side elevation view of an embodiment of a sampling device according to the principles of the present invention.
Figure 2:
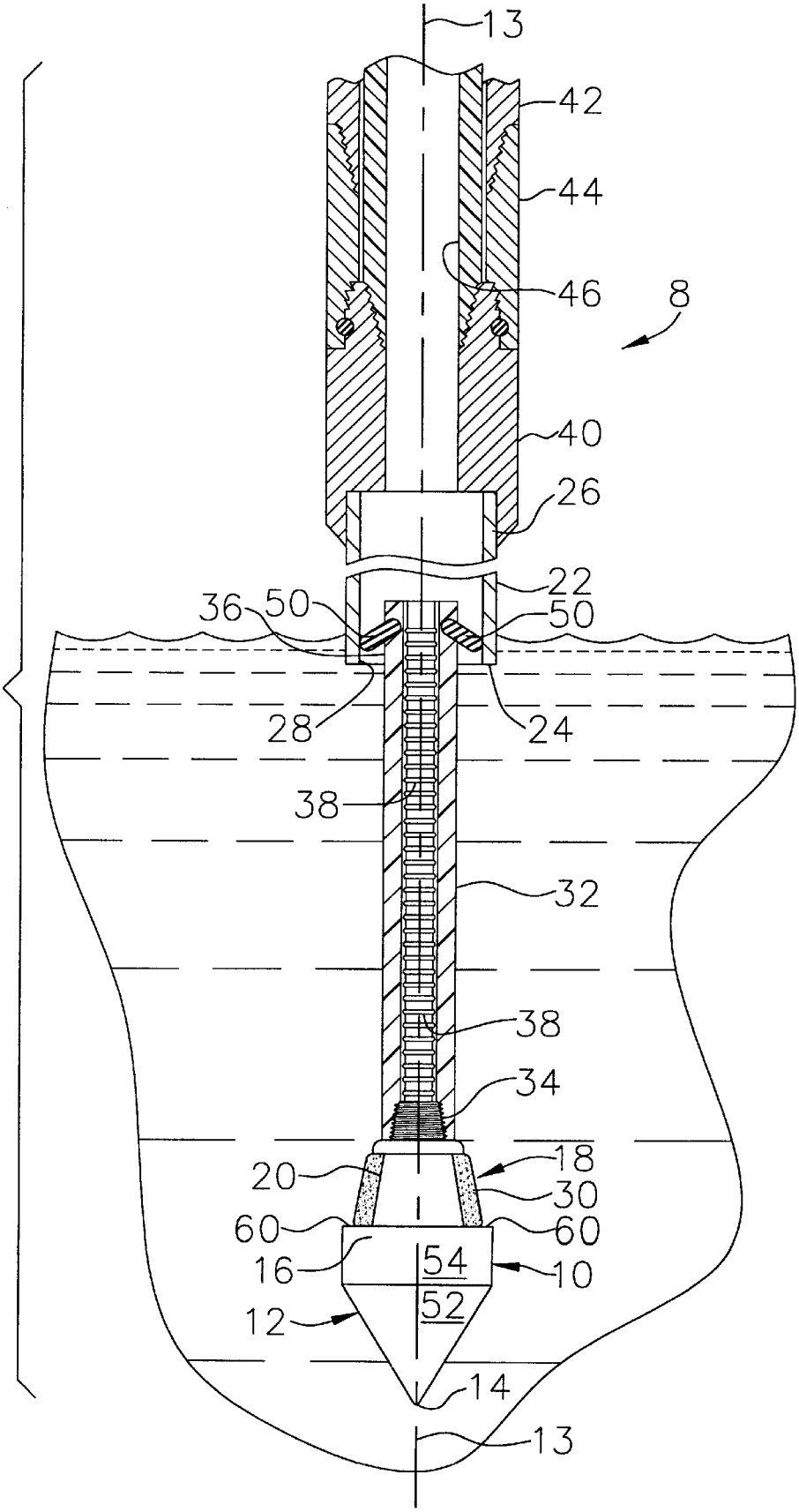
FIG. 2 is a schematic side elevation view of the drive point device of FIG. 1 shown driven and installed into the ground.

Referring to the drawings, wherein like reference numerals designate identical or corresponding parts throughout the several views and embodiments, an exemplary embodiment of a sampling device provided according to the principles of the present invention is illustrated in FIGS. 1 and 2 and identified by reference numeral 8. As shown in the figures, the sampling device 8 includes a removably attached drive point device 10 at its lowermost portion. The drive point device 10 includes a lower portion or drive cone 12 which extends along a longitudinal axis 13 between a lower end or tip 14 and an upper end 16. The drive cone 12 is configured for penetrating the ground to form a borehole. A stub 18 having an elongated circumferential groove 20 extends longitudinally away from the upper end 16 of the drive cone 12. The drive point device 10 is configured to be removably coupled with an extension tube or tubular point holder 22 as will be described in greater detail below.

The tubular point holder 22 extends along the longitudinal axis 13 between a point holder bottom end 24 and a point holder top end 26. The point holder bottom end 24 surrounds at least a portion of the stub 18 when the drive point 10 is coupled to the point holder 22. More specifically, the point holder bottom end 24 includes an inner diameter 28 which surrounds and is removably coupled to at least a portion of the stub 18.

An annular seal 30 is seated within the circumferential groove 20 and frictionally couples the stub 18 with the inner diameter 28 of the point holder bottom end 24. The annular seal 30 is made from a highly compressible and expansive material which facilitates coupling with point holder bottom ends 24 having a range of different inner diameters 28 and which prevents the passage of groundwater or soil between the drive point 10 and the point holder bottom end 24. The compressibility of the annular seal 30 allows it to be squeezed into tubular point holders 22 having a relatively small inner diameter 28. Because of its natural expansion, the same annular seal 30 can expand against the inside diameter 28 of tubular point holders 22 having larger inner diameters 28.

In the illustrated embodiment, a perforated pipe 32 is disposed within the tubular point holder 22. The perforated pipe 32 extends along the longitudinal axis 13 between a pipe lower end 34 and a pipe upper end 36. The pipe lower end 34 is in contact with the stub 18 and the pipe upper end 36 extends upwardly within the tubular point holder 22. Preferably, the pipe lower end 34 is threaded or otherwise coupled to the stub 18. Perforations 38 within the perforated pipe 32 are configured to allow the groundwater or other sampling fluid to enter or exit, while filtering the groundwater to prevent the entry of dirt, mud, soil, rocks and other undesirable objects.

In the illustrated embodiment, a sealing body 40 is disposed circumferentially around the top end 26 of the tubular point holder 22. The sealing body 40 has a larger diameter than the point holder 22 and thus, seals tightly against the borehole.

An elongated annular drive rod 42 is removably coupled to the tubular point holder top end 26 and is configured for pushing, driving or otherwise forcing the drive point device 10, coupled to the point holder 22, into the ground. The annular drive rod 42 may extend upwardly along the longitudinal axis above the ground. More than one annular drive rod segment 42 may be sequentially connected as necessary to extend their length and to facilitate forcing the drive point device 10 to the desired depth in the ground.

In the illustrated embodiment, a suitable releasable connecting means 44 is employed, such as a pin and key way, releasing adapter or other type of connection to permit disconnection of the annular drive rod 42 from the tubular point holder 22. The presently preferred releasable connecting means 44 includes reverse threads disposed at adjacent ends of the sealing body 40 so that the annular drive rod 42 can be released from the sealing body 40 by rotation of the annular drive rods. Releasing the annular drive rod 42 isolates the tubular point holder 22 and the perforated pipe 32, along with the drive point device 10, which remain in the ground. The annular drive rods 42 may then be removed.

A drop pipe 46 is disposed within the annular drive rod 42 and is fluidly connected with the perforated pipe 32. The drop pipe 46, like the perforated pie 32, may be made from an inexpensive material such as a PVC pipe or other plastic pipe. However, hose, tubing or other materials may be used as is known to those of skill in the art. Alternatively, the drop pipe 46 may be connected with a screen tube or screened section which acts in a similar fashion as the perforated pipe 32.

Prior to driving the drive point device 10 into the ground, the stub 18 of the drive point device 10 is inserted into the point holder bottom end 24 until the annular seal 30 is compressed and frictionally couples the two parts together. In some circumstances, this frictional coupling may not be sufficient to maintain the drive point within the point holder bottom end 24. When this occurs, a coupling device 48 may be used to assist in removably coupling the drive point device 10 and the point holder bottom end 24. In the illustrated embodiment, the coupling device 48 is a wide elastic band, such as a rubber band. The band 48 is placed such that it surrounds both the point holder bottom end 24 and the upper end 16 of the drive point device 10 to assist in temporarily retaining the drive point device 10 in the point holder 22. The sampling device 8 is then forced into the ground until the drive point device 10 is positioned at the desired location and depth. Driving the sampling device into the ground forces the band 48 from engagement.

The drop pipe or other fluid passage device 46 is then be passed through the annular drive rods 42 and fluidly connected to the perforated pipe 32 or screen intake. The annular drive rods 42 and coupled tubular point holder 22 may now be retracted from the drive point device 10 which is frictionally fixed in the ground. Retraction of the tubular point holder 22 and annular drive rods 42, as best illustrated in FIG. 2, is further described in U.S. Pat. No. 5,570,747, issued to me, and herein expressly incorporated in its entirety by reference.

Raising the annular drive rods 42 with the sampling device 8 in place causes the tubular point holder 22 to be raised relative to the drive point device 10 which is frictionally held in the ground. This raising separates the tubular point holder 22 from the stub 18 and exposes the interior perforated pipe 32 so as to allow fluid to enter. A first resilient seal 50, such as a cup seal, rod wiper or o-ring is preferably provided about the perforated pipe upper end 36 to seal the pipe with the tubular point holder 22 and prevent the ingress of contamination into the interior. The first resilient seal 50 allows slidable contact between the outer diameter of the perforated pipe 32 and the inner diameter 28 of the tubular point holder 22.

Once the tubular point holder 22 is separated from the drive point device 10, the annular drive rods 42 may be removed for reuse, leaving the drop pipe 46 sealably attached to the perforated pipe 32 or screen. Fluid-sampling devices may be inserted or a vacuum may be applied or pressurized fluid for sparging may be introduced, as desired.

Figure 3:
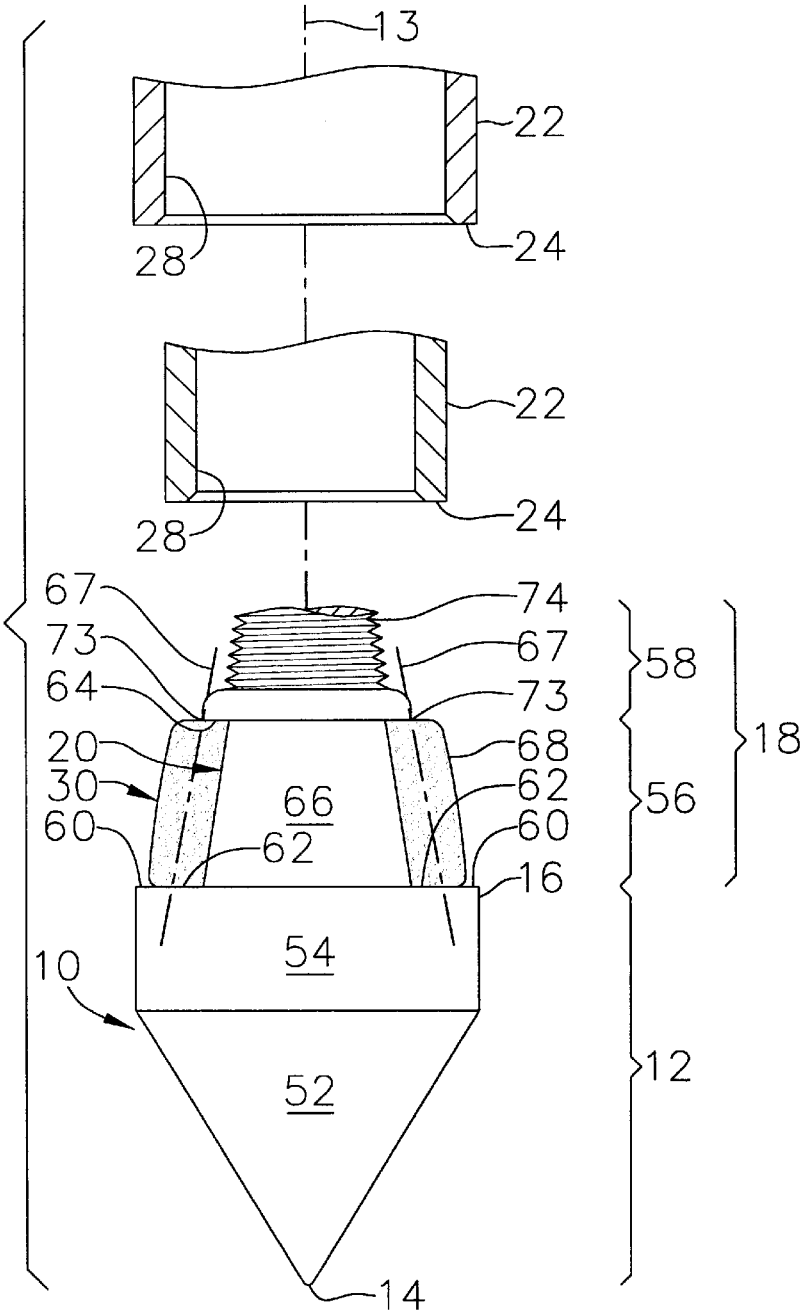
FIG. 3 is an enlarged schematic side elevation view of the drive point device of FIG. 1.
Figure 4:
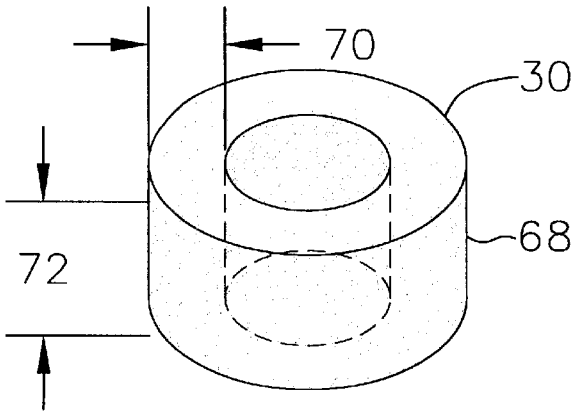
FIG. 4 is a perspective view of an embodiment of an annular seal according to the principles of the present invention.

Referring now to FIGS. 3 and 4, an exemplary drive point device 10, including the annular seal 30, will be described in greater detail. The drive cone 12 of the drive point device 10, which extends between the lower end 14 and the upper end 16 along the longitudinal axis 13, includes a tapered portion 52 and a constant radius portion 54. The tapered portion 52 extends upwardly from the drive point lower end 14 to the constant radius portion 54. As previously described, the tapered portion 52 forms the shape of a cone. This tapered shape facilitates penetration of the drive point device 10 into the ground and formation of the borehole.

The constant radius portion 54 extends longitudinally between the tapered portion 52 and the upper end 16. In the exemplary embodiment, the constant radius portion 54 defines the overall diameter of the borehole below the sealing body 40. The drive cone 12 of the drive point device 10 may also have other configurations. For example, the constant radius portion 54 may be omitted or the tapered portion 52 may have differing tapers and taper configurations. Such tapered configurations may include concave or convex surfaces, sharpened points, or even sharpened edges for penetrating the ground.

The stub 18 extends axially away from the upper end 16 of the drive cone 12. The stub 18 extends along the longitudinal axis 13 between a lower stub portion 56 and an upper stub portion 58. The lower stub portion 56 is integrally connected with the upper end 16 of the drive cone 12 and includes the circumferential groove 20. The upper stub portion 58 is adapted and configured for coupling with the perforated pipe lower end 34, as best illustrated in FIGS. 1 and 2.

More specifically, the stub 18 is axially aligned along the longitudinal axis 13 and has a diameter less than the constant radius portion 54 of the drive point device 10. The annular space between the outer diameter of the stub 18 and the outer periphery of the drive cone upper end 16 defines a shoulder 60. In addition, a lower circumferential groove wall 62, which is also at the junction of the drive cone upper end 16 and the outer diameter of the lower stub portion 56, is defined. As illustrated, the shoulder 60 and the lower groove wall 62 share a continuous flat surface which extends radially inwardly from the perimeter of the upper end 16.

The shoulder 60 provides both support and a physical stop for the bottom end 24 of the tubular point holder 22 when receiving the stub 18. The lower groove wall 62 defines the circumferential groove 20 and provides a lower wall to support the annular seal 30. In the exemplary embodiment, the shoulder 60 is substantially perpendicular to the longitudinal axis 13, as best illustrated in FIG. 1. However, other configurations and surface orientations may also be used. For example, the shoulder 60 may have an annular groove or slot which captures and prevents flaring of the point holder bottom end 24. The stub 18, the shoulder 60 and the upper end 16 of the drive cone 12 preferably all have circular cross sections to facilitate coupling with a cylindrical tubular point holder 22.

In the illustrated embodiment, the tubular point holder 22 has an outer diameter which is substantially similar, or identical to, the maximum diameter of the drive point 10. Preferably, this maximum diameter is substantially equivalent to the constant radius portion 54 of the lower end 12. However, the tubular drive point holder 22 may have a slightly smaller diameter than the maximum diameter of the drive point device 10 to prevent frictional contact within the borehole. Alternatively, a larger diameter point holder 22 may be used.

The lower groove wall 62 is spaced apart from an opposing upper circumferential groove wall 64 by an inner circumferential groove surface 66. The inner groove surface 66 is axially aligned along the longitudinal axis 13. The lower and upper groove walls 62 and 64 are substantially similar in annular width, which may also be termed radial thickness. In the presently described embodiment, the annular width of the lower groove wall 62 is determined by extending a line 67, from the outer edge 73 of the upper groove wall 64, parallel with the inner groove surface 66 to the surface defining the lower groove wall 62, as best illustrated in FIG. 3.

Preferably, the opposing groove walls 62 and 64 are generally perpendicular to the longitudinal axis 13. However, they may be angled to better conform to the desired shape of the annular seal 30. Preferably, the inner groove surface 66 has an axial length that is greater than the annular width of either of the opposing groove walls 62 and 64. This configuration allows for an elongated annular seal to be seated in the circumferential groove 20 as will be described in greater detail below.

In the embodiment illustrated in FIG. 3, the inner groove surface 66 of the circumferential groove 20 is tapered. This taper increases the radial diameter of the inner groove surface 66 as it extends from the upper groove wall 64 axially to the lower groove wall 62. The tapered inner groove surface 66 physically forces the surrounding annular seal 30 to also taper radially outwardly from the upper groove wall 64 to the lower groove wall 62. More specifically, the annular seal 30 includes an outer surface 68 which is physically forced by the tapered inner groove surface 66 to taper radially outwardly from the upper groove wall 64 to the lower groove wall 62.

The annular seal 30 is seated within the circumferential groove 20 and supported between the lower and upper groove walls 62 and 64. As is best illustrated in FIG. 4, the annular seal 30 has a wall or radial thickness 70 and an axial length or height 72. Preferably, the height 72 of the seal 30 is slightly greater than the axial length of the circumferential groove 20 to provide a compression fit within the lower and upper walls 62 and 64. A compression fit causes a central portion of the outer surface 68 of the seal 30 to bow radially outwardly and effectively provides a greater diameter annular seal 30 which can accommodate a wider range of tubular point holder inner diameters 28. Preferably, the height 72 of the seal is also greater in dimension than the thickness 70.

In a preferred embodiment, the inner groove surface 66 and hence, the circumferential groove 20, has an axial length or height of at least two times the annular width or wall thickness of the upper groove wall 64. A circumferential groove 20 having an axial length of at least two times its annular width, results in a drive point device 10 which accommodates a desirable range of tubular point holder inner diameters 28. For a fixed taper along the outer surface 68 of the annular seal 30, increasing the axial length of the groove 20 increases the range of tubular point holder inner diameters 28 that can be accommodated. In some embodiments, the circumferential groove 20 has a much greater axial length to width ratio than two to one. For example, the circumferential groove 20 may have an axial length at least three times the annular width of either the upper or lower groove walls 64 and 62.

Preferably, the annular seal 30 has a height 72 greater than one and one-half times its thickness 70. An annular seal 30 having a height 72 of at least one and one half times the thickness 70 is called an "elongated" annular seal herein. The elongated annular seal 30 is preferred, in part, because the axial length or height of the circumferential groove 20 is preferably elongated relative to the annular width of the groove walls 62 and 64. The height 72 of the annular seal 30 may be much greater than one and a half times its thickness 70, especially when the seal 30 is to be mounted in a groove 20 which has an axial length or height greater than two times the annular width of the upper groove wall 64. Preferably, the annular seal 30 has a thickness 70 which exposes the outer surface 68 radially outward relative to the upper groove wall 64 and the lower groove wall 62.

Alternatively, the circumferential groove 20 may have an axial length of less than two times the annular width of either the upper or lower groove walls 64 and 62. In this configuration, the thickness 70 of the annular seal 30 is preferably much greater than the height 72 such that the outer surface 68 extends radially outward well beyond the stub 18. The highly compressible and expansive material of the annular seal 30 accommodates tubular point holders 22 of various inner diameter 28.

Referring now back to FIG. 3, the tapered outer surface 68 of the annular seal 30 advantageously allows the stub 18 to be inserted within point holders 22 which have bottom ends 24 with various inner diameters 28. The highly compressible and naturally expansive material of the annular seal 30 accommodates these different inner diameters. More specifically, the stub 18 of the drive point device 10 may be inserted within the point holder bottom end 24 until the outer surface 68 of the annular seal 30 contacts the point holder inner diameter 28. Depending on the size of the inner diameter 28, the stub 18 may be inserted to various depths within the bottom end 24 of the tubular point holder 22.

Once the outer surface 68 of the annular seal 30 contacts the inner diameter 28, the drive point device 10 may be further inserted to snugly fit the drive point device 10 within the point holder bottom end 24. This snug fit, or frictional coupling between the outer surface 68 and the inner diameter 28 maintains the drive point device 10 within the tubular point holder 22. The coupling device 48 may optionally be placed around the drive point device 10 and the point holder 22 to further secure them together until the sampling device 8 is driven into the ground.

The annular seal 30 is made from a soft, highly compressible and naturally expansive material. This is advantageous over conventional o-rings which are relatively non compressible and expansive. As used herein, the term "annular seal" shall mean, unless otherwise described, an annular seal made from a compressible and expansive material having a radial thickness 70 greater than the cross-sectional diameter of a conventional o-ring having a similar size or groove diameter. Preferably, the annular seal 30 is constructed from a material having a material durometer less than that of conventional o-rings and more preferably, has a material durometer of less than about 40.

The annular seal 30 provides the desired releasable frictional coupling, as well as facilitating a low pressure, water-tight seal between the drive point device 10 and the tubular point holder 22. The water-tight seal prevents groundwater ingress into the tubular point holder 22 and thus, the perforated pipe 32, as the sampling device 8 is being driven into the ground. Preferably, the annular seal 30 comprises a material, or blend of materials, which has closed pores or closed cells and which is compressible to a smaller size but impermeable to fluids such as water. The releasable frictional coupling allows the tubular point holder 22 to be slidably retracted or otherwise removed from the stub 18 as the drive rods 42 are retracted.

In preferred embodiments, the annular seal 30 may be made from any variety of natural or synthetic rubbers, including sponge rubbers, which are highly compressible and impermeable to water. For example, the annular seal 30 may be made from: buna rubbers; neoprene rubbers; blends, including neoprene, SBR (styrene butadiene rubber) and EDPM (ethylene propylene diene methylene terpolymer); as well as other ethylene propylene rubbers. Other rubbers may also be used and include silicone rubbers; urethane rubbers; nitrile rubbers, including vinyl nitrites; polyethylenes, including chlorosulfonated polyethylene synthetic rubbers such as a HYPALON manufactured by Du Pont de Nemours, E.I. & Company; and fluoroelastomers, such as a VITON, also manufactured by Du Pont de Nemours, E.I. & Company.

In a preferred embodiment, the annular seal 30 is a closed cell polyethylene sponge, such as the polyethylene sponge sold under the brand name "THERMA-CEL" manufactured by Rubatex Company, of Roanoke, Virginia. The THERMA-CEL material is provided in a hollow cylindrical form which is cut to form a seal of the desired height. Alternatively, the annular seal 30 may include a plurality of individual annular seals which are aligned along the length of the circumferential groove 20. The annular seal 30 may also include finned, cupped or other specially shaped seals, such as a wiper or even a gasket.

In the exemplary embodiment, the upper stub portion 58 of the drive point 10 terminates in a threaded portion 74 which provides means for connecting the perforated pipe 32 to the drive point. The threaded portion 74 is tapered to allow threadable insertion within perforated pipes 32 of different internal diameters. Preferably, the threads 74 are self-tapping pipe threads to allow the plastic or other soft material of the perforated pipe 32 to "self-thread" or "self-tap" and form a connection with the drive point device 10. Alternatively, the threaded portion 74 may be configured to engage matching threads pre-cut within the perforated pipe 32. In lieu of threads, the upper stub portion 58 may be provided with concentric barbs which fasten the pipe 32 to the drive point device 10 or any other device for securing or otherwise supporting the pipe 32 as will be known to those of skill in the art.

Referring in particular to FIGS. 3 and 4, a specific example of an embodiment of a drive point device provided in accordance with the principles of the present invention will now be described. In this embodiment, the drive cone 12 extends approximately 2.0 inches along the longitudinal axis 13 between the upper end 16 and the lower end 14. Of this 2.0 inches, the constant radius portion 54 extends from the upper end 16 towards the lower end 14 for approximately ⅜ inches. The constant radius portion 54 defines the maximum outer diameter of the drive point device 10 and is often referred to by this maximum outer diameter. Thus, in the exemplary configuration, the drive point device 10 may be referred to as a 2-inch drive point. The drive cone 12 tapers from the constant radius portion 54 to a point at the lower end 14. It should be noted that by varying the axial length or extension of the constant radius portion 54 from the upper end 16, the angle of the tapered portion 52 may be increased or alternatively decreased.

The stub 18 extends outwardly from the upper portion 16 for approximately 1.75 inches. Of the stub 18 total length, the lower stub portion 56 is approximately 0.5 inch long, and the upper stub portion 58 is approximately 1.25 inches long. These are exemplary dimensions and may be altered to accommodate different sized annular seals 30 as well as different sized tubular point holders 22 as is known to those of skill in the art.

The lower stub portion 56 includes the portion of the stub 18 extending axially between the upper end 16 of the drive cone 12 and the upper groove wall 64. In the exemplary embodiment, this distance is the length or axial height of the circumferential groove 20 because the lower groove wall 62 is at the same axial position as the upper end 16 of the drove cone 12. Many other configurations of the shoulder 60 and lower groove wall 32 may be used as will be known to those of skill in the art. For example, the lower groove wall 62 may be axially spaced apart from the upper end 16 of the drive cone 12 to form a centering stub portion which will be described in greater detail below as an alternative embodiment.

In the exemplary embodiment, the circumferential groove 20 is tapered as previously described. This taper changes the diameter of the inner groove surface 66 along its axial length from a maximum diameter of approximately 1.07 inches at the lower groove wall 62 to a minimum diameter of approximately ⅝ inches at the upper groove wall 64. The taper or changing diameter of the inner groove surface 66 is generally uniform between the maximum and minimum diameters.

The lower groove wall 62 and integral shoulder 60 define a common surface having an annular width of approximately 0.47 inches. Of this dimension, the lower groove wall has an annular width of approximately 0.2 inches while the annular shoulder 60 has an annular width of approximately 0.27 inches. The annular width of the shoulder 60 extends inwardly from the outer peripheral edge of the upper end 16 to the lower groove wall 62.

The upper groove wall 64 has a maximum outer diameter of approximately 1.25 inches. This provides an upper groove wall 64 having an annular width of approximately 0.2 inches. The upper groove wall 64 may include a relatively sharp outer edge 73 where it transitions into a elongated threaded portion 74 at its maximum outer diameter. The sharp edge 73 facilitates the capture and retention of the annular seal 30 within the circumferential groove 20.

In the exemplary embodiment, the upper stub portion 58, including the threaded portion 74, extends from the upper groove wall 64 along the longitudinal axis 13 for approximately 1.25 inches. The threaded portion 74 only comprises a portion of the total length of the upper stub portion 58. Alternatively, the upper stub portion 58 may be threaded along its entire axial length. The threaded portion 74 includes self-tapping threads which taper radially inwardly from a maximum outer diameter of approximately 1.25 inches adjacent the upper groove wall 64. It should be noted that the longitudinal length of the threaded portion 74 as well as the outer diameters and taper may easily be increased or alternatively decreased to accommodate differing drop pipes and particularly differing drop pipe inner diameters.

In the illustrated embodiment, the annular seal 30 is a closed cell polyethylene sponge having an inner diameter of approximately ⅞ inches and a wall thickness 70 of approximately ⅜ inches. As illustrated, the thickness 70 of the annular seal 30 protrudes radially outwardly from the upper groove wall 64, yet does not protrude beyond the maximum outer diameter of the upper end 16 of the drive cone 12. Preferably, the thickness 70 of the annular seal 30 leaves at least a portion of the annular shoulder 60 exposed.

In a preferred embodiment, the thickness 70 of the annular seal 30 is at least approximately 0.2 inches and less than approximately ½ inch. If the thickness 70 is less than 0.2 inches, the annular seal 30 will not protrude beyond the upper and lower groove walls 64 and 62 and frictional coupling may be compromised. If the thickness 70 is more than approximately ½ inch, the annular seal 30 will protrude substantially beyond the upper and lower groove walls 64 and 62 as well as the shoulder 60.

The annular seal 30 has a height 72 greater than ½ inch and is preferably approximately ⅝ inches. Providing an annular seal 30 having a height 72 greater than the length of the circumferential groove 20 allows slight compression of the annular seal 30 when captured between the upper and lower groove walls 64 and 62.

The drive point device 10 may be made from a metal such as a steel or an aluminum. An aluminum such as type 6061-T6 provides an efficient drive point device which is lightweight. However, a steel such as type 1215S may be used to provide additional strength. Other materials such as alloys, stainless steels, composites, and other hard plastics may also be used.

The drive point device 10 may be constructed using common machines and processes for forming metal components as will be known to those of skill in the art. For example, the drive point device 10 may be constructed using a CNC controlled lathe, an engine lathe, a screw lathe machine or the like. The placement of threads may require the use of a second machine or second machining step, such as the use of a CNC controlled lathe configured for cutting threads. Other machines and processes, such as casting, stamping, forging and milling may also be used to fabricate the drive point device 10 as will be known to those of skill in the art.

Figure 5:
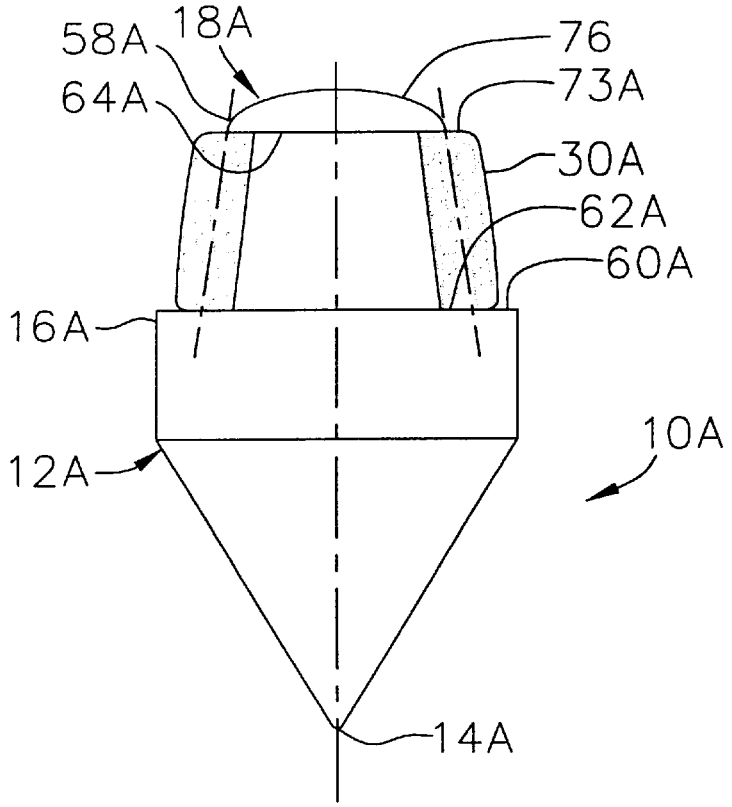
FIG. 5 is a schematic side elevation view of a first alternative embodiment of a drive point device according to the principles of the present invention.

Alternative drive point device configurations to those shown in FIGS. 1 through 3 are shown in FIGS. 5 through 9. Referring now particularly to FIG. 5, an alternative embodiment of a drive point device constructed in accordance with the principles of the present invention is shown. In this embodiment, like features to those of the previous embodiment are designed by like reference numerals, succeeded by the letter "A." In the exemplary embodiment illustrated, the drive point device 10A has a flanged portion or cap 76 disposed on the upper stub portion 58A. The cap 76 is integrally formed with the upper groove wall 64A. The outer surface of the cap 76 is designed to support the lower end of the perforated pipe (32 of FIG. 1). Thus, the cap 70 may have an outer surface which is rounded as illustrated or alternatively may be flat and even cupped.

Figure 6:
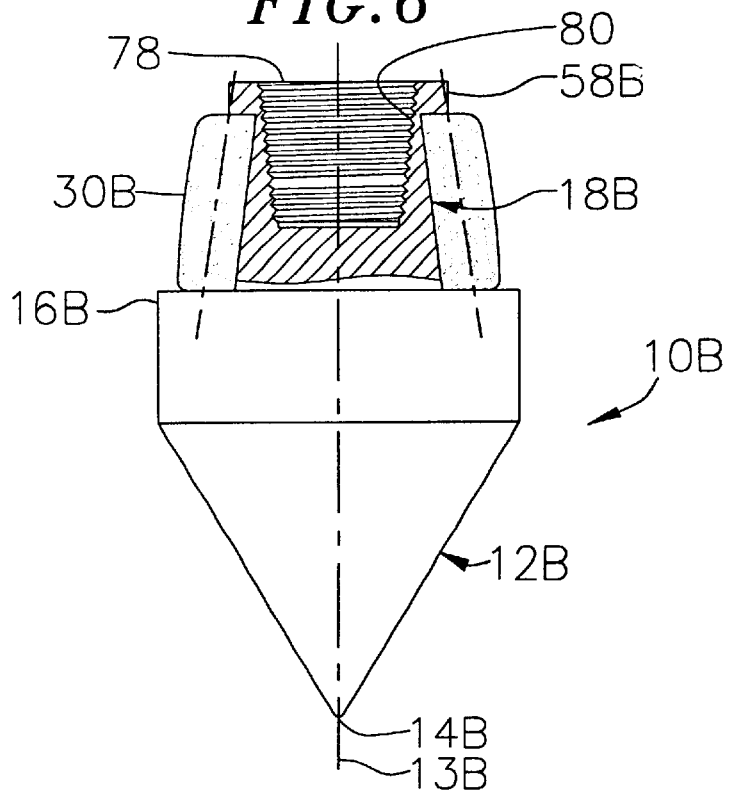
FIG. 6 is a schematic side elevation view of a second alternative embodiment of a drive point device according to the principles of the present invention.

Another variation of the present invention is illustrated in FIG. 6. In this embodiment, like features to those of previous embodiments are designated by like reference numerals succeeded by the letter "B." As illustrated, the drive point device 10B includes an upper stub portion 58B having a cavity 78 centrally disposed along a longitudinal axis 13B. The cavity 78 is sized to receive the outer diameter of the perforated pipe lower end (34 of FIG. 1) and may include means 80 for securing the pipe lower end to the drive point device 10B. Preferably, this means 80 is a set of internal threads along an inner surface of the cavity 78 which extends into the stub 18B.

The internal threads 80 may be tapered to accommodate contact with perforated pipes (32 of FIG. 1) of various outer diameters. Preferably, the cavity 78 has a decreasing diameter as it increases in depth to form a narrowing tapered configuration. The threads 80 may also be self-tapping to facilitate engaging the outer diameter of the pipe to thereby secure the pipe to the drive point device 10B. Preferably, the perforated pipe includes a pipe lower end (34 of FIG. 1) made from a relatively soft material, such as a PVC plastic, which can be engaged and threaded by the threads 80 within the cavity 78.

Figure 7:
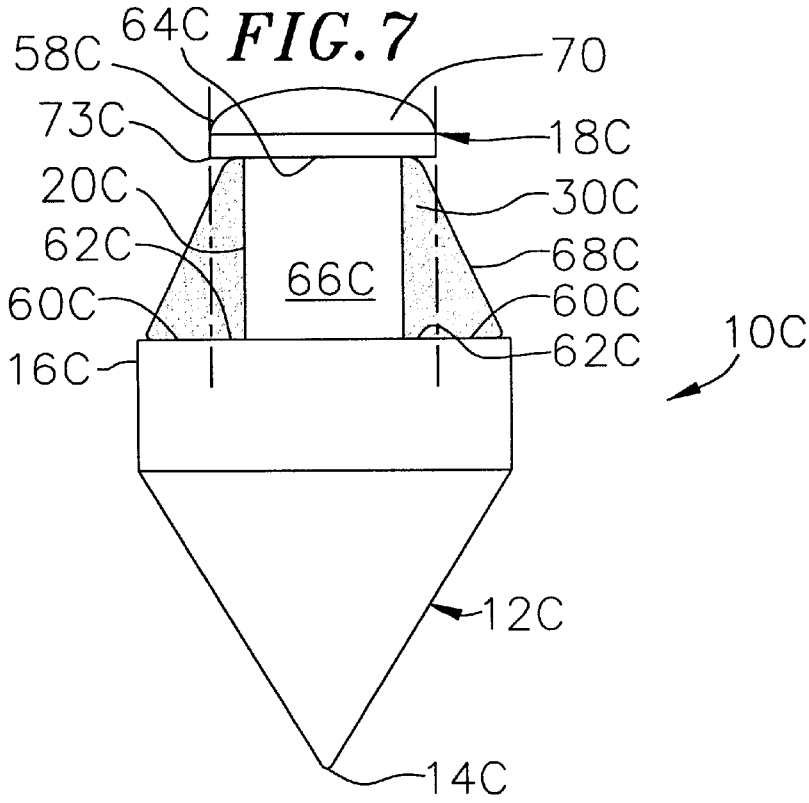
FIG. 7 is a schematic side elevation view of a third alternative embodiment of a drive point device according to the principles of the present invention.

Another alternative drive point configuration according to the principles of the present invention is shown in FIG. 7. In this embodiment, like features to those of previous embodiments are designated by like reference numerals, succeeded by the letter "C." In this embodiment, the drive point device 10C includes a stub 18C with a circumferential groove 20C having a constant diameter along its axial length. Thus, the inner groove surface 66C has a constant diameter between the upper and lower groove walls 64 and 62. The stub 18C The upper stub portion 58C may include any of the previously described configurations for coupling or otherwise supporting the perforated pipe lower end (34 of FIGS. 1 and 2) with the drive point device 10C.

The non-tapered inner groove surface 66C may advantageously reduce the overall machining costs of the drive point device 10C and thus reduce the overall cost of production. In order to compensate for not having a tapered inner groove surface 66C, the annular seal 30C is configured with a tapered outer surface 68C. This tapered seal outer surface 68C facilitates the frictional coupling and sealing within various inner diameters of the tubular point holder (22 of FIG. 3). Preferably, the angle or taper of the outer seal surface 68C is substantially similar to the taper of the inner groove surface (66 of FIG. 3)and as previously described. However, the angle or taper of the tapered outer surface 68C may be varied to accommodate differing ranges of point holder inner diameters (28 of FIG. 3)as well as the desired degree of frictional coupling.

Figure 8:
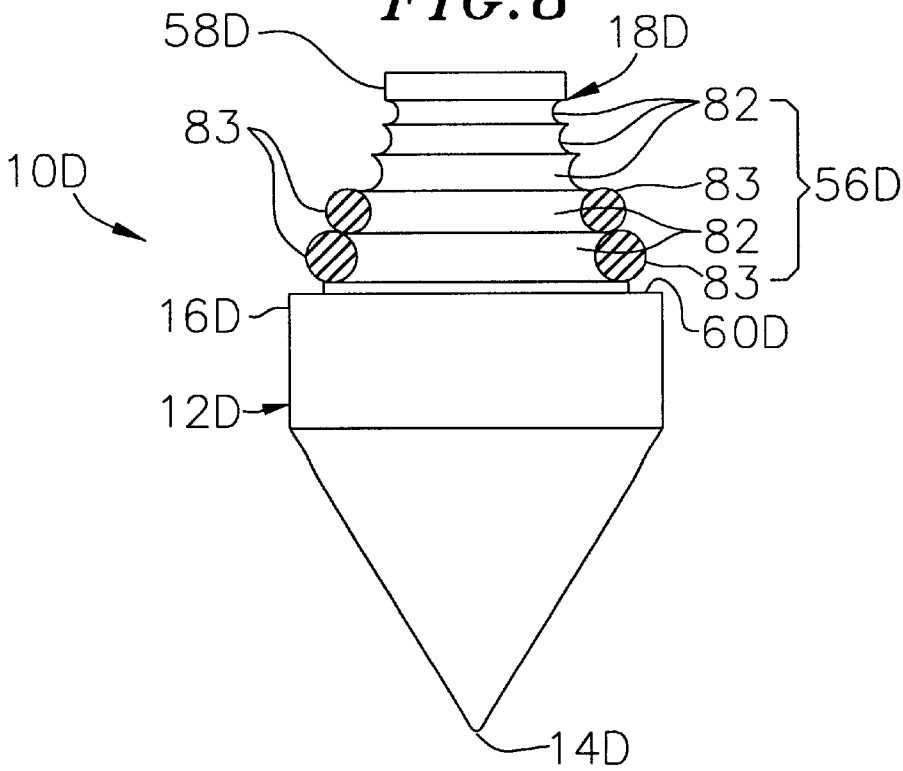
FIG. 8 is a schematic side elevation view of a fourth alternative embodiment of a drive point device and annular seal according to the principles of the present invention.

Referring to FIG. 8, another alternative embodiment of a drive point configuration according to the present invention will be described. In this embodiment, like features to those of previous embodiments are designated by like reference numerals, succeeded by the letter "D." As illustrated, the drive point device 10D includes a stub 18D having a plurality of generally parallel and axially adjacent circumferential grooves 82. Preferably, the circumferential grooves 82 are disposed sequentially along a lower stub portion 56D which tapers outwardly along a longitudinal axis 13D from an upper stub portion 58D to a shoulder 60D. The taper provides for each of the circumferential grooves 82 to increase in annular diameter sequentially along the lower stub portion 56D. Similar to the previous embodiments, the upper stub portion 58D may be configured with any means or device for connection with the perforated pipe, screen or other similar component (32 of FIGS. 1 and 2).

In the exemplary embodiment illustrated, each of the circumferential grooves 82 is configured for supporting a conventional o-ring 83. Each of the substantially similar o-rings 83 is stretched to a different annular diameter according to the respective circumferential groove 82. Alternatively, two or more o-rings 83 may be placed within each circumferential groove 82.

In yet another alternative, the circumferential grooves 82 may be formed having sequentially increasing cross sectional diameters along the tapered lower stub portion 56D. The increased cross sectional diameters of the circumferential grooves 82 support o-rings 83 having sequentially larger cross sectional diameters as well as larger annular diameters. As an alternative to o-rings 83, the circumferential grooves 82 may be configured to support a plurality of finned seals, cup seals, wipers or annular seals made from a highly compressible and expandable material as described herein.

Figure 9:
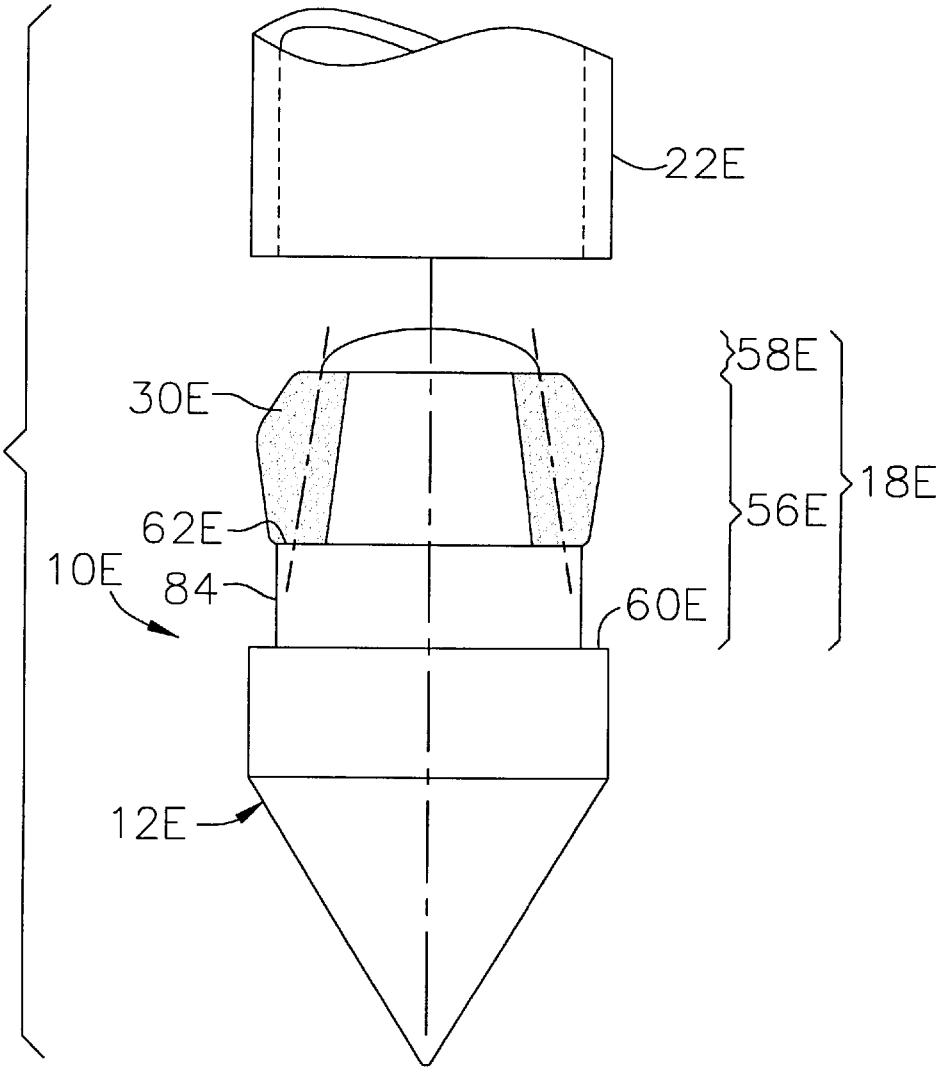
FIG. 9 is a schematic side elevation view of a fifth alternative embodiment of a drive point device according to the principles of the present invention.

Yet another variation of the present invention is illustrated in FIG. 9. In this embodiment, like features to those of previous embodiments are designated by like reference numerals succeeded by the letter "E." As illustrated, the drive point device 10E includes a stub lower portion 56E having a groove lower wall 62E axially spaced apart from a shoulder 60E. In this embodiment, a centering stub 84 is defined axially between the shoulder 60E and the lower groove wall 62E. The centering stub 84 is configured to center the tubular point holder 22E around the stub 18E. The centering stub 84 also provides support for the drive point 10E within the tubular point holder 22E and prevents side to side movement. Similar to that described in the previous embodiments, the upper stub portion 58E may be configured with any means or device for connection with a perforated pipe, screen or other similar component (32 of FIGS. 1 and 2).

It will be understood that various modifications can be made to the disclosed embodiments of the present invention without departing from the spirit and scope thereof. For example, various sizes of the drive point device and particularly, the circumferential groove and annular seal, are contemplated as well as various types of seal materials. Also, various modifications may be made to the configuration of the parts and their interaction. Therefore, the above description should not be construed as limiting the invention, but merely as an exemplification of preferred embodiments thereof. Those of skill in the art will envision other modifications within the scope and spirit of the present invention as defined by the appended claims.

What is claimed is:

1. A drive point device for removable coupling with a tubular point holder, the drive point device comprising:

a drive cone having an outer surface extending between a lower end and an upper end along a longitudinal axis, the outer surface tapering radially outwardly from the lower end and being configured for penetrating the ground to form a borehole;

a stub extending from the upper end of the drive cone along the longitudinal axis and configured for insertion within a bottom end of the tubular point holder, the stub having a circumferential groove;

an annular seal supported within the circumferential groove and adapted for frictionally coupling with and sealing against an inner diameter within the bottom end of the tubular point holder, wherein the annular seal is highly compressible and expandable to accommodate tubular point holders of different inner diameters; and wherein the annular seal has an axial height and an annular thickness, and the axial height is at least one and one-half times the annular thickness.

2. The drive point device as recited in claim 1 wherein the annular seal comprises a closed cell elastomeric material.

3. The drive point device as recited in claim 1 wherein the annular seal comprises a tapered outer surface to facilitate coupling with tubular point holders of different inner diameters.

4. The drive point device as recited in claim 1 wherein the circumferential groove comprises an inner groove surface which tapers radially outwardly from an upper groove wall to a lower groove wall.

5. The drive point device as recited in claim 1 wherein the circumferential groove comprises an inner groove surface which has a substantially constant diameter along the longitudinal axis.

6. A drive point device for removable coupling within a bottom end of a tubular point holder and adapted to be driven into the ground by application of a force, the drive point device comprising:

a drive cone having an outer surface extending between a lower end and an upper end along a longitudinal axis, the outer surface tapering radially outwardly from the lower end and being configured for penetrating the ground to form a borehole; and a stub extending along the longitudinal axis outwardly from the upper end and configured for insertion within a bottom end of the tubular point holder, said stub including a circumferential groove having a tapered inner groove surface for supporting an annular seal and for tapering an outer surface of said annular seal radially outwardly from an upper groove wall to a lower groove wall.

7. The drive point device as recited in claim 6, and further comprising an axially elongated annular seal supported within the circumferential groove and adapted for frictionally coupling and sealing against an inner diameter within the bottom end of the tubular point holder, wherein the elongated annular seal is highly compressible and expandable to facilitate coupling with tubular point holders of different inner diameters.

8. The drive point device as recited in claim 7 wherein the elongated annular seal comprises a closed cell elastomeric material.

9. The drive point device as recited in claim 7 wherein the elongated annular seal comprises a closed cell polyethylene sponge.

10. The drive point device as recited in claim 7 wherein the elongated annular seal comprises a soft rubber.

11. A sampling device adapted to be driven into the ground to form a borehole, the sampling device comprising:

a drive point extending along a longitudinal axis between a drive cone and an upper stub, the drive cone adapted for penetrating the ground and the stub having an axially elongated circumferential groove with an inner groove surface tapering radially outwardly from an upper groove wall to a lower groove wall;

a tubular point holder extending along the longitudinal axis between a point holder bottom end and a point holder top end, the point holder bottom end surrounding at least a portion of the stub;

an annular seal supported within the circumferential groove, for frictionally coupling and sealing the drive point against an inner diameter of the point holder bottom end, the annular seal being highly compressible and expandable to facilitate coupling with point holder bottom ends of different inner diameters;

a perforated pipe disposed within the tubular point holder and extending along the longitudinal axis between a pipe lower end and a pipe upper end, the pipe lower end contacting an upper end of the stub;

a sealing body disposed circumferentially about a top portion of the tubular point holder and adapted for sealing the tubular point holder against the borehole;

a hollow annular drive rod extending between a drive rod lower end and a drive rod upper end, the drive rod lower end removably coupled to the tubular point holder top end and adapted for forcing the drive point and the coupled tubular point holder into the ground; and a drop pipe disposed within the annular drive rod and fluidly connected with the perforated pipe.

12. The sampling device as recited in claim 11 wherein the annular seal comprises an elastomeric material.

13. The sampling device as recited in claim 11 wherein the pipe lower end is coupled to an upper end of the stub.

14. The sampling device as recited in claim 11, and further comprising an elastomeric band removably coupling the point holder bottom end and the drive point.

15. A drive point device for removable coupling with a tubular point holder, the drive point device comprising:

a drive cone having an outer surface extending between a lower end and an upper end along a longitudinal axis, the outer surface tapering radially outwardly from the lower end and being configured for penetrating the ground to form a borehole;

a stub extending from the upper end of the drive cone along the longitudinal axis and configured for insertion within a bottom end of the tubular point holder, the stub having a circumferential groove; and an annular seal supported within the circumferential groove and adapted for frictionally coupling with and sealing against an inner diameter within the bottom end of the tubular point holder, wherein the annular seal is highly compressible and expandable to accommodate tubular point holders of different inner diameters and wherein the annular seal includes an axial height and an annular thickness, and the height is at least one and one-half times the thickness.

16. The drive point device as recited in claim 15 wherein the annular seal comprises a closed cell elastomeric material.

17. The drive point device as recited in claim 15 wherein the annular seal comprises a tapered outer surface to facilitate coupling with tubular point holders of different inner diameters.

18. The drive point device as recited in claim 15 wherein the circumferential groove comprises an inner groove surface which tapers radially outwardly from an upper groove wall to a lower groove wall.

19. The drive point device as recited in claim 15 wherein the circumferential groove comprises an inner groove surface which has a substantially constant diameter along the longitudinal axis.

20. A drive point device for removable coupling with a tubular point holder, the drive point device comprising:

a drive cone having an outer surface extending between a lower end and an upper end along a longitudinal axis, the outer surface tapering radially outwardly from the lower end and being configured for penetrating the ground to form a borehole;

a stub extending from the upper end of the drive cone along the longitudinal axis and configured for insertion within a bottom end of the tubular point holder, the stub having a circumferential groove and the circumferential groove comprising an inner groove surface which tapers radially outwardly from an upper groove wall to a lower groove wall; and an annular seal supported within the circumferential groove and adapted for frictionally coupling with and sealing against an inner diameter within the bottom end of the tubular point holder, wherein the annular seal is highly compressible and expandable to accommodate tubular point holders of different inner diameters.

21. The drive point device as recited in claim 20 wherein the annular seal comprises a closed cell elastomeric material.

22. The drive point device as recited in claim 20 wherein the annular seal comprises a tapered outer surface to facilitate coupling with tubular point holders of different inner diameters.

23. The drive point device as recited in claim 20 wherein the annular seal includes an axial height and an annular thickness, and the height is at least one and one-half times the thickness.

24. The drive point device as recited in claim 20 wherein the circumferential groove comprises an inner groove surface which has a substantially constant diameter along the longitudinal axis.

25. A drive point comprising:

a cone;

a stub extending from the cone; and a circumferential groove formed about the stub, the circumferential groove being tapered to facilitate coupling of the drive point with drive point holders of different inner diameters.

26. A drive point comprising:

a cone;

a stub extending from the cone;

a circumferential groove formed about the stub; and an annular seal supported within the circumferential groove, the annular seal comprising a tapered outer surface to facilitate coupling of the drive point with drive point holders of different inner diameters.

* * * * *